US006916354B2

(12) United States Patent
Elliott

(10) Patent No.: US 6,916,354 B2
(45) Date of Patent: Jul. 12, 2005

(54) TUNGSTEN/POWDERED METAL/POLYMER HIGH DENSITY NON-TOXIC COMPOSITES

(75) Inventor: Kenneth H. Elliott, Baltimore (CA)

(73) Assignee: International Non-Toxic Composites Corp., Baltimore (CA)

( * ) Notice: Subject to any disclaimer, the term of this patent is extended or adjusted under 35 U.S.C. 154(b) by 210 days.

(21) Appl. No.: 10/270,354

(22) Filed: Oct. 15, 2002

(65) Prior Publication Data

US 2003/0164063 A1 Sep. 4, 2003

Related U.S. Application Data

(60) Provisional application No. 60/329,307, filed on Oct. 16, 2001.

(51) Int. Cl.[7] ..... F42B 10/00
(52) U.S. Cl. ..... 75/228; 102/517
(58) Field of Search ..... 75/228; 102/517; 524/439, 440, 445

(56) References Cited

U.S. PATENT DOCUMENTS

| | | | |
|---|---|---|---|
| 4,780,981 | A | 11/1988 | Hayward et al. |
| 4,850,278 | A | 7/1989 | Dinkha et al. |
| 4,881,465 | A | 11/1989 | Hooper et al. |
| 4,939,996 | A | 7/1990 | Dinkha |
| 4,949,644 | A | 8/1990 | Brown |
| 4,949,645 | A | 8/1990 | Hayward et al. |
| 4,958,572 | A | 9/1990 | Martel |
| 4,981,512 | A | 1/1991 | Kapoor |
| 5,069,869 | A | 12/1991 | Nicolas et al. |
| 5,088,415 | A | 2/1992 | Huffman et al. |
| 5,159,007 | A | 10/1992 | Saitoh et al. |
| 5,189,252 | A | 2/1993 | Huffman et al. |
| 5,237,930 | A | 8/1993 | Belanger et al. |
| 5,263,417 | A | 11/1993 | Godfrey-Phillips |
| 5,264,022 | A | 11/1993 | Haygarth et al. |
| 5,279,787 | A | 1/1994 | Oltrogge |
| 5,333,550 | A | 8/1994 | Rodney et al. |
| 5,385,101 | A | 1/1995 | Corzine et al. |
| 5,399,187 | A | 3/1995 | Mravic et al. |
| 5,442,989 | A | 8/1995 | Anderson |
| 5,500,183 | A | 3/1996 | Noordegraf et al. |
| 5,513,689 | A | 5/1996 | Montgomery et al. |
| 5,527,376 | A | 6/1996 | Amick et al. |
| 5,535,495 | A | 7/1996 | Gutowski |

(Continued)

FOREIGN PATENT DOCUMENTS

| | | |
|---|---|---|
| CA | 2095232 | 5/1992 |
| CA | 2202632 | 4/1996 |
| CA | 2248282 | 10/1997 |
| GB | 531389 | 1/1941 |
| WO | WO 86/04135 | 7/1986 |
| WO | WO 93/22470 | 11/1993 |
| WO | WO 00/37878 | 6/2000 |
| WO | WO 02/87808 | 11/2002 |

OTHER PUBLICATIONS

"Tungsten Outflanks Lead", *The International Journal of Powder Metallurgy* (2001) 37(1):20.

*Manufacturing with Materials*, Lyndon Edwards and Mark Endean (eds.), (1990) Butterworth–Heinemann, Oxford, UK, pp 207–221.

*Process Selection: From Design to Manufacture*, K.G. Swift and J.D. Booker, (1997) Arnold Publishers, London, UK.

*Primary Examiner*—Daniel Jenkins
(74) *Attorney, Agent, or Firm*—Anissimoff & Associates; Hans Koenig

(57) ABSTRACT

Tungsten/polymer composites comprising tungsten powder, another metal powder having a high packing density, and organic binder have high density, good processibility and good malleability. Such composites are useful as lead replacements, particularly in the manufacture of shot.

33 Claims, 9 Drawing Sheets

U.S. PATENT DOCUMENTS 5,535,678 A 7/1996 Brown
5,540,749 A 7/1996 Li et al.
5,549,048 A 8/1996 Godfrey-Phillips et al.
5,616,642 A 4/1997 West et al.
5,665,808 A 9/1997 Bilsbury et al.
5,679,920 A 10/1997 Hallis et al.
5,686,693 A 11/1997 Jakobsson
5,713,981 A 2/1998 Amick et al.
5,719,352 A 2/1998 Griffin
5,728,349 A 3/1998 Persson
5,760,331 A 6/1998 Lowden et al.
5,763,819 A 6/1998 Huffman
5,786,416 A 7/1998 Gardener
5,789,698 A 8/1998 Beal
5,814,759 A 9/1998 Mravic et al.
5,831,188 A 11/1998 Amick et al.
5,847,313 A 12/1998 Beal
5,852,255 A 12/1998 Hallis et al.
5,852,858 A 12/1998 Hallis et al.
5,877,437 A 3/1999 Oltrogge
5,894,644 A 4/1999 Mravic
5,894,645 A 4/1999 Hallis et al.
5,913,256 A 6/1999 Lowden et al.
5,950,064 A 9/1999 Robinson et al.
5,963,776 A 10/1999 Lowden et al.
6,016,754 A 1/2000 Enlow et al.
6,045,601 A 4/2000 Tan
6,048,379 A 4/2000 Bray et al.
6,071,359 A 6/2000 Wisniewski et al.
6,074,454 A 6/2000 Abrams et al.
6,085,661 A 7/2000 Halverson
6,090,178 A 7/2000 Benini
6,112,669 A 9/2000 Mravic et al.
6,149,705 A 11/2000 Lowden et al.
6,158,351 A 12/2000 Mravic et al.
6,174,494 B1 1/2001 Lowden et al.
6,182,574 B1 2/2001 Giannoni
6,202,561 B1 3/2001 Head et al.
6,216,598 B1 * 4/2001 Godfrey Phillips ..... 102/507
6,248,150 B1 6/2001 Amick
6,257,149 B1 7/2001 Cesaroni
6,258,316 B1 7/2001 Buenemann et al.
6,263,798 B1 7/2001 Benini
6,270,549 B1 8/2001 Amick
6,300,399 B1 10/2001 Gallucci et al.
6,317,946 B1 11/2001 Beal
6,530,328 B2 3/2003 Burczynski et al.
6,536,352 B1 3/2003 Nadkarni et al.
6,551,375 B2 4/2003 Siddle et al.
2001/0050020 A1 12/2001 Davis et al.
2002/0005137 A1 1/2002 Stone
2002/0124759 A1 9/2002 Amick

* cited by examiner

TUNGSTEN/POWDERED METAL/POLYMER HIGH DENSITY NON-TOXIC COMPOSITES

CROSS-REFERENCE TO RELATED APPLICATIONS

This application claims the benefit of U.S. Provisional Application No. 60/329,307 filed Oct. 16, 2001.

FIELD OF THE INVENTION

This invention relates to composite materials, particularly to composite materials that can be used as lead replacements.

BACKGROUND OF THE INVENTION

Lead has been used in a variety of industrial applications for many thousands of years. In the last hundred years, the toxic effects of lead ingestion on humans, and wildlife in general, have become apparent. Throughout the world various environmental agencies classify the metal and many lead compounds, including oxides, as Hazardous Wastes.

As an example, in the USA, about 51% of lead solid waste, has in the past, been due to spent ammunition and ordinance. Lead shot used for hunting waterfowl is now prohibited because of its toxicity to birds that are wounded but not killed and to wildlife that ingest loose shot. Firing of small arms ammunition for training, sporting, law enforcement and military purposes contributes a significant potential for environmental pollution and constitutes a human health risk. In the USA the Department of Energy, (DOE), expends about 10 million rounds of small arms ammunition each year, resulting in a deposit of over 100 tonnes of lead. The DOE's use of ammunition is small compared with that of civilians, law enforcement agencies and the Department of Defence. Overall, it is estimated that in the USA, hundreds of tonnes of lead are released into the environment every day.

By way of a further example, lead is commonly used to balance automobile wheels. Wheel balancing weights are applied to wheel rims to compensate for static and dynamic unbalances and guarantee true running of the tyres. The European End of Life Vehicle (ELV) Directive aims at reducing the use of hazardous materials and states in Article 2.2(a):

Member States shall ensure that materials and components of vehicles put on the market after 1 Jul. 2003 do not contain lead, mercury, cadmium or hexavalent chromium other than in cases listed in Annex II under the conditions specified therein [emphasis added].

Between 1991–1992 a study was carried out in Houston, USA, by the Houston Advanced Research Centre, (HARC in which weights had been collected from the roadside, having been lost from vehicles. Hundreds of lead weights weighing 26 kg had been collected from a four-mile stretch of road over 9 months.

In a 1999 letter to the Electronics Engineering Times, an individual in the US reported casually finding about 2.5 kg of lead weights on a short stretch of busy road in just 1 day. A more detailed study was carried out in Albuquerque, N.Mex., USA, and published by Root. This showed that very large quantities of lead weights were lost from vehicles—approximately 8 kg/km/year for a large urban highway rising to between 50 and 70 kg/km/year at one intersection. A total of 3.7 tonnes per year was estimated for the major Albuquerque thoroughfares.

The total quantity of weights deposited on the roads of the UK and Europe cannot be estimated accurately but is possibly of the order of 1,500 tonnes per year, representing a loss of around 1 in 10 fitted weights.

Alternative materials for weights evaluated so far are tin, steel, zinc, tungsten, plastic (thermoplastic PP) and ZAMA, which is an alloy of ZnAl4Cu1. All these materials apart from tungsten have densities far below that of lead and do not have the ideal combination of mechanical and physio-chemical properties.

In an effort to reduce reliance on lead in many applications, there has recently been extensive research into materials that could be used to replace it.

In this regard, much effort has been focused on producing metal composites that mimic the properties of lead. Since the density of lead is the most obvious characteristic to mimic, most efforts have concentrated on finding composites that have the same or similar density. However, other important properties of lead have been largely ignored and, as a result, no completely satisfactory lead replacement has yet been found.

In addition to the requirement of being non-toxic and to having a similar density to lead, a successful composite should have reasonable formability coupled with structural rigidity. For many of the lead replacement applications envisaged, the composite should ideally be substantially homogeneous and relatively low cost to manufacture in large quantities.

Tungsten-polymer composites have been used as lead-free systems for various applications. A practical limitation of these systems is that the packing characteristics of commercial tungsten powders are typically poor owing to their non-spherical shape and typically agglomerated state. The inferior packing density results in poor theological characteristics of highly loaded suspensions of tungsten powder in a molten polymer. Consequently, shape forming with these mixtures is not straightforward. Thus, the maximum density obtainable by these mixtures is typically below about 11 g/cc.

U.S. Pat. No. 6,045,601 describes the use of a mixture of tungsten, stainless steel and an organic binder in a process to prepare a sintered final article that is devoid of the organic binder. The mixture of tungsten, stainless steel and an organic binder is not intended as a final article and does not possess the desired impact characteristics since it is made with a large wax component that is brittle in nature.

U.S. Pat. No. 5,616,642 describes lead-free frangible ammunition made from a metal powder, a polyester and a small amount of ionomer. The composites described in this patent do not possess a combination of high density, suitable processing characteristics and malleability.

U.S. Pat. No. 6,048,379 describes a composite material comprising tungsten, fibre and binder. There is no teaching of the composite materials comprising tungsten powder with another metal powder having a high packing density.

There still remains a need for a tungsten/polymer composite material having a suitably high density, suitable processing characteristics and suitable malleability.

SUMMARY OF THE INVENTION

The present invention provides an article of manufacture comprising a composite comprising: (a) tungsten powder; (b) another metal powder having a high packing density; and, (c) an organic binder.

There is also provided a composite comprising: (a) tungsten powder; (b) another metal powder having a high packing density; and, (c) an organic binder.

Further provided is a process for producing an article of manufacture, the process comprising:

(a) mixing tungsten powder and another metal powder having a high packing density to form a powder mix;

(b) formulating the powder mix and organic binder into the composite; and (c) forming the composite into the article of manufacture without sintering.

BRIEF DESCRIPTION OF THE DRAWINGS

The invention will now be described by way of non-limiting example with reference to the following drawings.

DESCRIPTION OF PREFERRED EMBODIMENTS

Composites:

Tungsten is used in the composite preferably in an amount of about 80–99%, or about 80–97%, or about 80–96%, or about 87–93%, by weight of the composite. Tungsten is used in the form of tungsten powder that is usually polygonal in shape. The mean particle size is preferably about 0.5–50 $\mu$m, more preferably about 1–50 $\mu$m, more preferably still 2–20 $\mu$m and more preferably still 1–10 $\mu$m.

Figure 1:
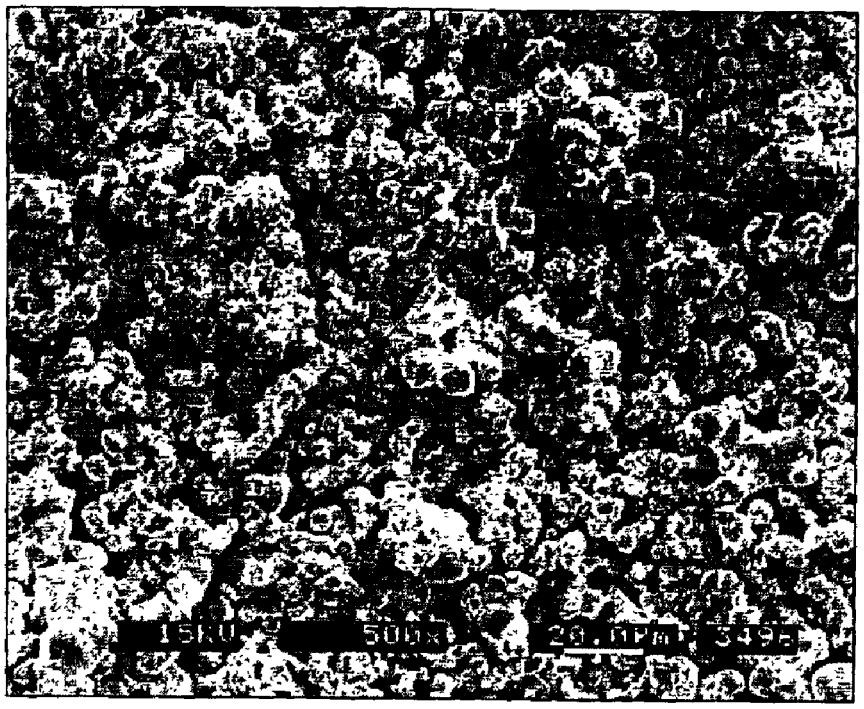
FIG. 1 is an electron micrograph of as-received tungsten powder prior to rod milling.
Figure 2:
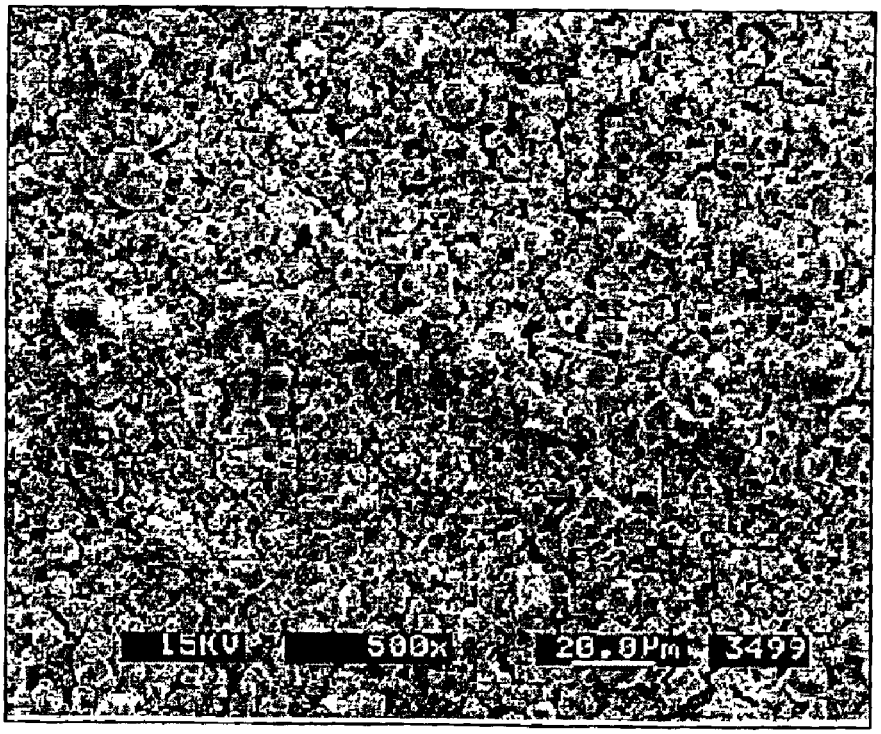
FIG. 2 is an electron micrograph of tungsten powder after rod milling.
Figure 3:
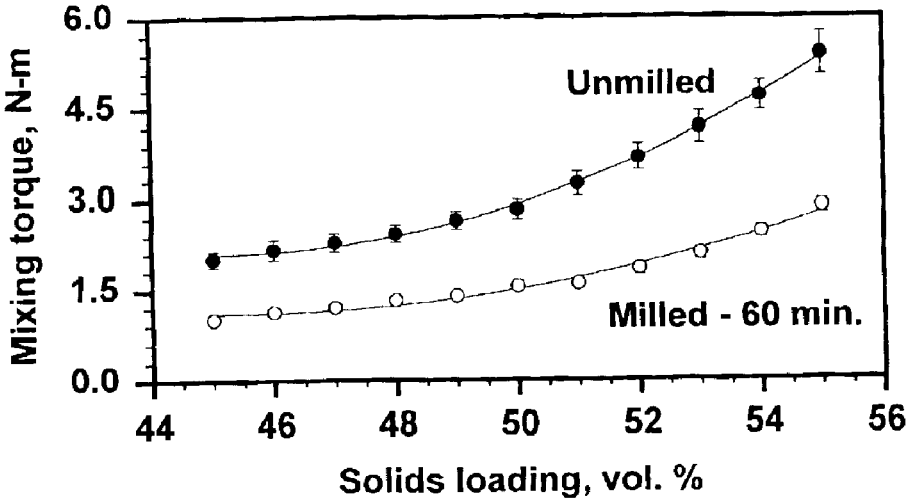
FIG. 3 is a graph of mixing torque as a function of solids loading for milled and unmilled tungsten powder.
Figure 4:
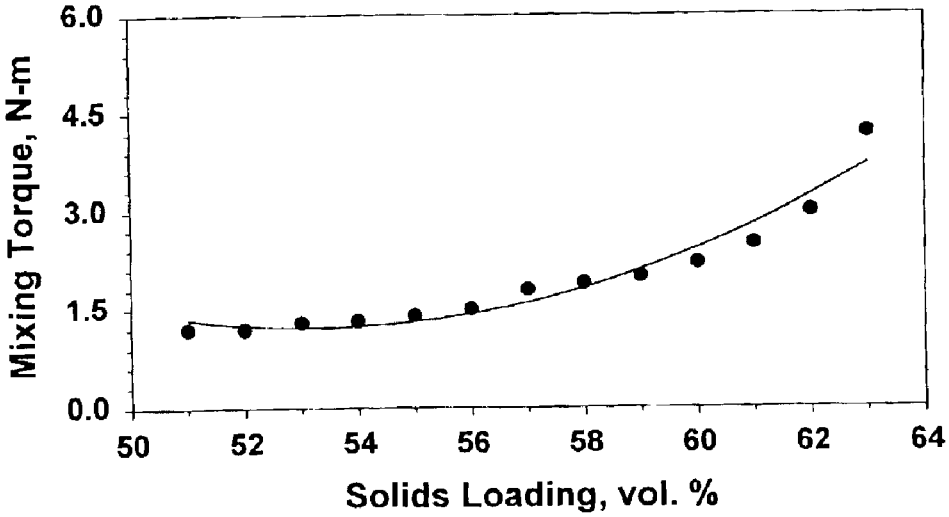
FIG. 4 is a graph of mixing torque as a function of solids loading for rod-milled tungsten powder.

The tungsten powder is preferably milled to deagglomerate the fine particle clusters that are usually present and to improve the packing density. This is illustrated by FIGS. 1 and 2. Deagglomerating the tungsten powder by rod-milling results in a lower and more uniform melt viscosity of the tungsten/other metal powder/binder mix. This is evident from the variations in the mixing torque of the composite during melt processing for various as-received and processed tungsten powders. FIG. 3 shows mixing torque as a function of solids loading for milled and unmilled tungsten powder. FIG. 4 shows mixing torque as a function of solids loading for rod-milled tungsten powder. In both FIGS. 3 and 4, the binder phase used was a paraffin wax-polypropylene-stearic acid blend and the melt temperature was 170° C. The results of FIG. 3 are typical for commercial grades of tungsten powder. When the results of the rod-milled powder of FIG. 4 are compared to those of the milled powder of FIG. 3, the maximum loading levels of FIG. 4 show a 7% gain in loading to reach 3 N-m.

The use of another metal in powder form, rather than in other forms such as fibres, is believed to contribute to superior packing in the composite resulting in higher achievable densities and superior rheology in suspensions. Preferably, the other metal powder is substantially or essentially spherical to further maximise packing density when mixed with the tungsten powder. The other metal can be any metal that has a high packing density when blended with tungsten. For randomly packed spherical metal particles, a packing density of 62% by volume or greater is considered high. For ordered packing of spherical (i.e. hexagonal close packing), a packing density of 72% by volume or greater is considered high. For randomly packed spherical metal particles of a metal powder having a wide or bimodal particle size distribution, a packing density of 72% by volume or greater is considered high. Preferably, the other metal is an austenitic or ferritic stainless steel, iron, ferrous alloy, or bronze. Bronze is a copper/tin alloy typically having a Cu:Sn ratio of about 90:10, although other ratios of Cu:Sn may be possible. However, increasing the proportion of tin in the bronze may result in an increase in viscosity during processing which makes processing more difficult. The other metal is preferably present in the composite in an amount of about 2–15%, or about 3–15%, or about 7–12%, by weight of the composite. The mean particle size is preferably about 1–50 $\mu$m, more preferably about 1–40 $\mu$m, more preferably still about 5–25 $\mu$m and more preferably still about 13–15 $\mu$m.

Figure 5:
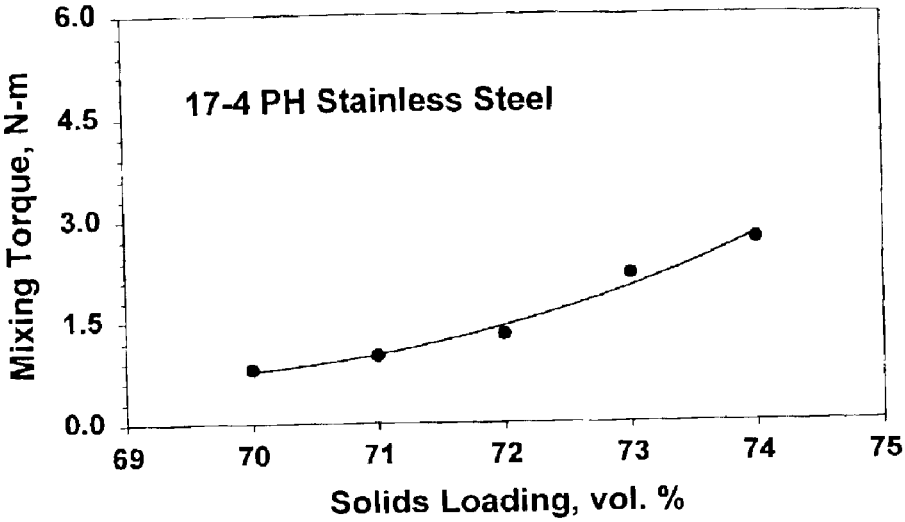
FIG. 5 is a graph of mixing torque as a function of solids loading of 17-4PH stainless steel powder.

Like tungsten, the other metal powder can also be milled to provide increased loading capacity. FIG. 5 shows mixing torque as a function of solids loading of 17-4 PH stainless steel powder. The binder phase used was a paraffin wax-polypropylene-stearic acid blend. The melt temperature was 170° C. Loading levels shown are 10% higher than typical unmilled powders commercially available.

The relative particle size of the metal powders as well as their relative proportions in the mixture are usually adjusted in order to obtain the desired combination of density and processibility. The mean particle size of the other metal powder could be smaller than that of the tungsten so that the other metal powder particles will conveniently fill the spaces between tungsten particles, which increases the compaction of the composite resulting in a higher density. Alternatively, controlling the width of the particle size distribution will enable the production of a mix of suitable packing density.

Organic binders are generally melt processible, have glass transition temperatures well below room temperature, and provide good impact properties. The binder may comprise a single polymeric entity or a blend of different polymers. The organic binder may also be referred to as an organic matrix binder since it remains part of the finished article after processing and becomes part of the matrix for holding the composite together. Since the final article in accordance with the present invention is not sintered, organic binder is not burned off and remains in the finished article.

The binder preferably comprises a relatively high viscosity rubbery phase provided by a thermoplastic elastomer (TPE) or a blend of thermoplastic elastomers. Examples of thermoplastic elastomers include, but are not limited to, polyether block amides (e.g. Pebax™ grades from Atofina), polyester elastomers (e.g. Hytrel™ grades from DuPont), melt processible rubber, chlorinated polyethylene (e.g. Tyrin™ grades from DuPont Dow Elastomers), ethylene propylene diene monomer (EPDM) rubber (e.g. Nordel™ grades from DuPont Dow Elastomers), polyamide elastomers (e.g. Grilamid™ grades from EMS-Chemie), polyolefin elastomers (e.g. ethylene octene copolymer) and thermoplastic polyurethanes (TPU).

Other processing aides that may also be present in the binder include, but are not limited to, rheology or flow modifiers, strength enhancing agents, surfactants (e.g. a wax and a fluoropolymer), and mixtures thereof. Some specific examples of other processing aides are ethylene vinyl acetate, chemically modified polyethylene, zinc stearate, ethylene-bis-stearamide, stearic acid, paraffin wax and polyvinylidene fluoride. As used herein, the term "organic binder" refers to all organic components in the composite.

The binder, including other processing aides, is preferably present in the composite in an amount of about 1–10%, or about 2–6%, by weight of the composite.

Packing density and overall density is achieved by the properties of the metal constituents. The organic binder essentially provides for the ductility, toughness and malleability of the composite. Densities obtainable in the composite are preferably 10.5 g/cc or higher, especially from 11.0 g/cc to 12.0 g/cc. The composites are both strong and ductile and are softer than steel on the surface. Composites of the present invention are used unsintered in the final article of manufacture.

The composite preferably consists essentially of tungsten powder, another metal powder having a high packing density, and an organic binder. However, the composite may include trace amounts of other material as impurities, such as other metals (for instance nickel, zinc, bismuth, copper, tin and iron). Also, as one skilled in the art will appreciate, incidental impurities may be present, which do not unduly affect the properties of the composite.

The characteristics of high density, shape preservation, strength and malleability of the composite of the present invention is a significant improvement over currently available composites, particularly for ballistic shot options. These characteristics make the composites of the present invention a good replacement for lead in a variety of finished articles.

Articles of Manufacture:

The unsintered composites of the present invention can be used in a variety of finished articles of manufacture, such as, for example, projectiles or ammunition (e.g., bullets, bullet cores and shot), weights (e.g., wheel balancing weights, such as clip-on balance weights and adhesive balance weights), radiation shielding and high-density gyroscopic ballasts. Preferably, the composite may be used in manufacturing projectiles or ammunition, particularly shot, since the composite has an excellent combination of density, processibility and malleability (deformation on impact), which is ideal for the manufacture of shot. In one method of making shot, semi-solid feedstock produced by melt-processing a composite of the present invention may be charged into an opening in a mould, through a channel and into mould cavities to form shot.

Processes:

A number of processes may be used to make the composites of the present invention and are generally disclosed in *Manufacturing with Materials*, eds. Lyndon Edwards and Mark Endean, 1990, Butterworth-Heinemann, Oxford, UK; and, *Process Selection: From Design to Manufacture*, K. G. Swift and J. D. Booker, 1997, Arnold Publishers, London, UK, the disclosures of which are hereby incorporated by reference. These processes include Powder-Injection Moulding and extrusion.

The composites of the invention include an organic binder, generally a thermoplastic binder, in sufficient quantity to allow shape forming methods to be used. Examples of this type of processing include Powder Injection Moulding (PIM). Powder injection molding (PIM) combines the processibility of plastics and the superior material properties of metals and ceramics to form high performance components. In recent years, PIM has emerged as a method for fabricating precision parts in the aerospace, automotive, microelectronics and biomedical industries. The important benefits afforded by PIM include near net-shape production of complex geometries at low cost and rapid fabrication at high production volumes. When using metal powder feedstock, the process is usually referred to as Metal Injection Moulding (MIM).

The MIM process consists of several stages. Metal powders and organic binder are combined to form a homogeneous mixture that is referred to as the feedstock. Usually, the feedstock is a precisely engineered system. The constituents of the feedstock are selected and their relative amounts are controlled in order to optimize their performance during the various stages of the process. Such control depends on the particular constituents and is best left to the judgement of one skilled in the art during the process. Injection of the feedstock into the mould is typically done at elevated temperatures (typically between 100° C. to about 350° C.). The semi-solid feedstock is used to mould parts in an injection moulding machine, in a manner similar to the forming of conventional thermoplastics. Cooling the moulded semi-solid composite yields a solid article.

One skilled in the art will understand that PIM and MIM techniques usually encompass a sintering step. Since the composites of the present invention are not sintered, PIM and MIM techniques applied to this invention are best viewed as modified PIM and MIM processes. Modified PIM and MIM processes (i.e. without sintering) are suitable processes for mass production of finished articles like weights (e.g. wheel weights) and ammunition (e.g. bullet cores, shot).

Extrusion involves mixing the metal powders and organic binder at an elevated temperature (typically at about 100–350° C., more preferably from about 250–285° C., still more preferably from about 250–270° C., followed by extruding the mixture through an open die into the form of wires, sheets or other simple shapes.

As an example, in this invention, tungsten and stainless steel powders are mixed together with organic binder to form a suspension and extruded to form a wire, strip or sheet. In most extrusion equipment there is a defined zone built in for compounding prior to the extrudate exiting the die nozzle. The wire, strip or sheet may then be formed into the desired article. For the production of shot, the wire, strip or sheet is stamped or rolled out to give substantially or essentially spherical composite particles. Press rolls may also be used to press the extruded composite into a desired thickness before the spherical composite particles are formed. The spherical composite parts may then be finished to produce shot.

In a further example, tungsten and stainless steel powders may be pre-mixed to form an intimate-mixture of metals and charged to the first port of an extruder followed by the addition of organic binder prior to extrusion; or, tungsten and the other metal powder may be pre-mixed with the organic binder, then compounded and pelletized, and charged to an extruder. Pre-mixing is generally done at ambient (room) temperature. The extruded composite, in the form of a wire, strip or sheet, may then be stamped progressively using a series or an array of punches to form regular indentations until the spherical composite parts are finally stamped out. Alternatively, spinning rolls with a dimpled texture may be used to form spherical composite parts.

In another aspect, the other metal powder together with organic binder may be charged to an extruder and tungsten introduced just prior to extrusion. The suspension to be extruded may be extruded cold, or, preferably, may be heated into a semi-solid state and maintained at an elevated temperature (typically at about 100° C. to about 350° C.). The semi-solid state comprises solid metal particles suspended in melted organic binder.

The residence time of the semi-solid suspension and the pressure in the compounder and/or extruder depend on the particular equipment being used and on the desired properties of the resultant composite. Determination of residence time and pressure is well within the scope of one skilled in the art to determine by simple experimentation.

It may be desirable to dry the metal powders before compounding and to degas the metal/binder suspension during compounding in order to reduce back pressure. Too much back pressure can lead to poor densification, to lack of uniformity of the composite and to unwanted density variations in the finished article.

Figure 6:
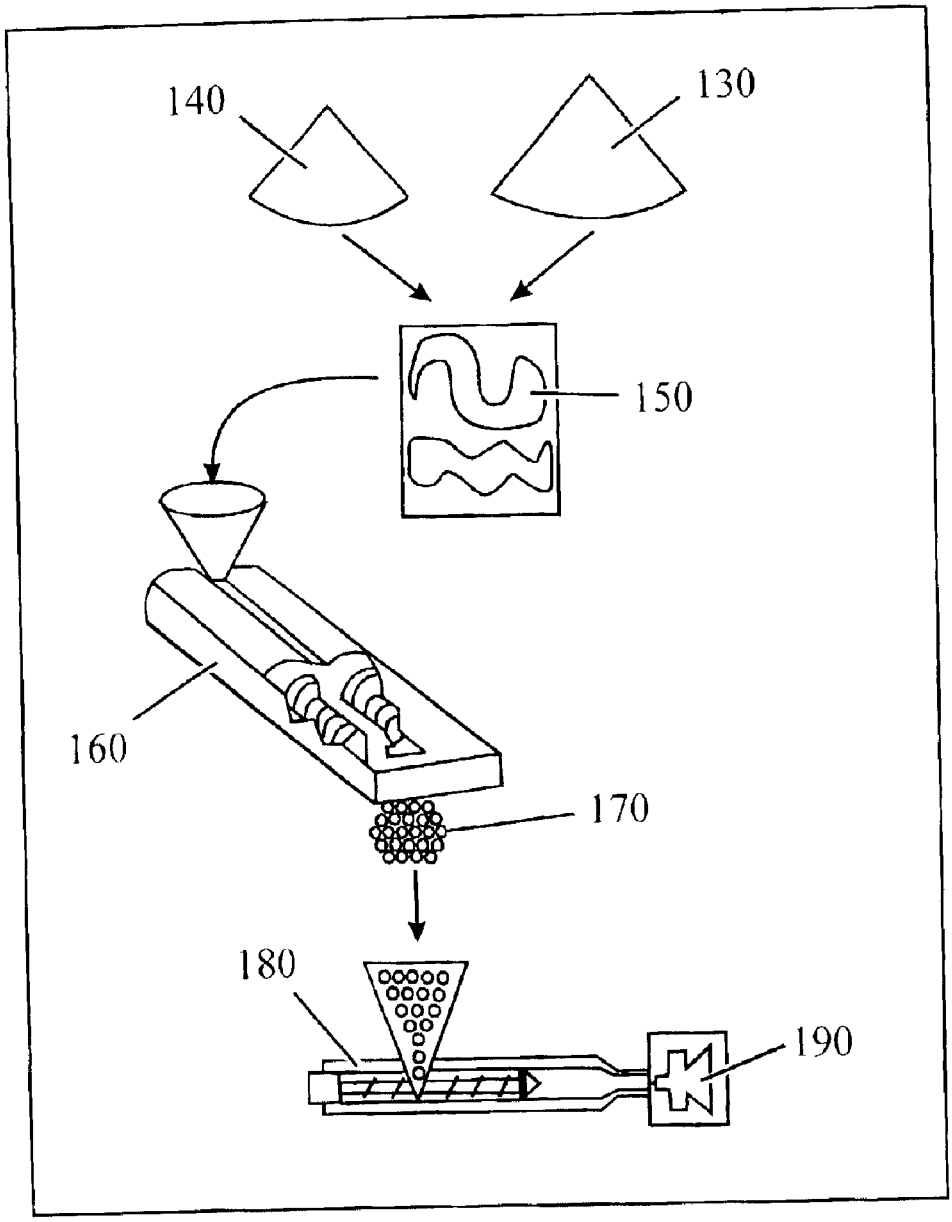
FIG. 6 is a diagram of a process for forming composites of the present invention.

FIG. 6 is a diagram of an injection moulding and extrusion process, which is suitable for forming articles of the present invention. In FIG. 6, tungsten powder (130) is combined with another metal powder having a high packing density (140) to form a blend of powders to which an organic binder is added (150). The blend is then charged into a compounder (160) for further mixing at an elevated temperature (e.g. 100–350° C.) and then extruded into a master batch of pellets (170). The pellets (170) are then charged into an extruder (180), which carries the semi-solid feedstock into the mould (190).

Figure 7:
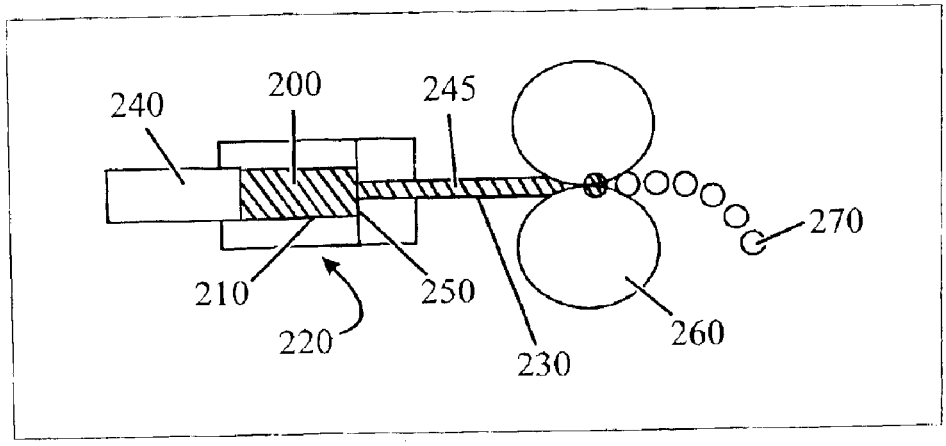
FIG. 7 is a diagram of a process for producing shot.

FIG. 7 is a diagram of an extrusion process suitable for producing shot. Tungsten powder-other metal powder-organic binder blend (200) is charged into a heated barrel (210) of an extruder (220). The blend (200) may be a simple blend or in a pelletized form as produced in FIG. 6. The mixture is heated in the barrel and forced through an extrusion nozzle (230) by an extrusion ram (240). The extrudate (245) is forced through a die plate (250) and extruded into a sheet, which is fed through two spinning rolls (260). The rolls have a dimpled surface to cut into the sheet and form shot (270).

Other techniques include tape casting, compaction, heading, roll-forming, and polymer-assisted extrusion. All of these approaches allow for the manufacture of net-shaped or near net-shaped green body high performance composite components by using the processibility of polymers with selected material property combinations of metals.

Tape casting usually involves mixing the metal powders and organic binder and extruding the mixture at room temperature into sheets.

Heading or roll-forming techniques, either cold or warm, is more rapid than injection moulding and is ideally suited to the manufacture of ammunition, such as shot, since high throughput is required to make the process more economical. Generally, the tungsten powder, the other metal powder and the organic binder are mixed to form a suspension and extruded to form a wire, strip or sheet. Shot is produced when dimples on the rolls of the apparatus cut into the extrudate thereby forming the shot.

In yet another technique, particularly adapted to producing shot, the ingredients of the composite including organic binder are mixed together, the organic binder is melted to form a suspension and the molten composite is dripped into small spheres.

All these processing techniques involve initial mixing of the metal ingredients with an organic binder to form a suspension of the metal particles in the organic binder. The organic binder contributes fluidity and modifies rheology of the composite mixture during processing, thus permitting the forming of accurate dimensional shapes.

In some cases, the preceding processes may be followed by high energy blending accomplished in a compounder. Typical compounders have a bore with a single or double screw feed and a series of paddles for slicing and shearing the feedstock. Improved densification can be achieved by compounding. The compounded mixture is then shaped by using one of a variety of forming techniques familiar to those skilled in the art.

All of these processing techniques can be used for the production of composite products. Each technique would be chosen depending upon complexity of end product and volume of production. Forming processes are typically carried out at temperatures and pressures that are predetermined by the rheology of the mixture of metal powders and organic binder.

EXAMPLES

In order to identify suitable compositions of metal powder and organic binder, calculations were performed using the inverse rule of mixtures for a two-component mixture.

$$\frac{1}{\rho_{mixture}} = \frac{1-X}{\rho_{binder}} + \frac{X}{\rho_{powder}}$$

where: X is the weight fraction of the metal powder in the composite $\rho_{mixture}$ is the density of the mixture $\rho_{binder}$ is the density of the organic binder $\rho_{powder}$ is the density of the metal powder The equation can be extended for mixtures containing more than two constituents. For the examples which follow, the metal powder phase consisted of tungsten and one other metal powder selected from the group consisting of 17-4 PH stainless steel, 90Cu:10Sn bronze and carbonyl iron. The solids loading of the metal powder mix was varied in the range of 55–65 vol %. The amount of tungsten in the mixture is represented as a weight fraction of the tungsten-metal powder mixture. The results of the calculations are presented below.

For each particular weight fraction of tungsten, the mix density is given as a range. The lowest number of the range represents the mix density at a solids loading of 55 vol %. The highest number represents the mix density at a solids loading of 65%. An incremental increase of 1 vol % in the solids loading corresponds to a proportionate incremental increase in the mix density between the lowest and highest mix densities given for the particular weight fraction of tungsten. For example, the mix density of tungsten/17-4 PH stainless steel at a tungsten weight fraction of 0.95 and a solids loading of 60 vol % is about 11 g/cc, which is the midpoint in the range of 10 to 12 g/cc given for a 0.95 weight fraction of tungsten in the tungsten/stainless steel mix.

Tungsten/17-4 PH Stainless Steel:

| wt. fraction of W | mix density (g/cc) |
|---|---|
| 0.8 | 8.5 to 10 |
| 0.85 | 9 to 10.75 |
| 0.9 | 9.5 to 11.25 |
| 0.95 | 10 to 12 |
| 1.0 | 11 to 13 |

Tungsten/90Cu:10Sn Bronze:

| wt. fraction of W | mix density (g/cc) |
|---|---|
| 0.8 | 9 to 10.5 |
| 0.85 | 9.25 to 11 |
| 0.9 | 10 to 11.75 |
| 0.95 | 10.25 to 12.25 |
| 1.0 | 11 to 13 |

Tungsten/Carbonyl iron:

| wt. fraction of W | mix density (g/cc) |
|---|---|
| 0.8 | 8.5 to 10 |
| 0.85 | 9 to 10.75 |
| 0.9 | 9.5 to 11.25 |
| 0.95 | 10 to 12 |
| 1.0 | 11 to 13 |

It can be inferred from the data above that the densest composites (densities >11 g/cc) can typically be obtained at solids loading >55 vol % and a tungsten fraction >95 wt % based on the weight of the composite.

In the following specific examples, the organic binder is a blend of several constituents:

- a relatively high viscosity rubbery phase provided by a thermoplastic elastomer (e.g., polyether block amides (Pebax™ grades from Atofina), polyester elastomers (Hytrel™ grades from Dupont), ethylene propylene diene monomer rubber (Nordel™ grades from Dupont Dow Elastomers));
- a rheology modifier for reducing the viscosity of the rubbery phase and provided by a low molecular weight polymer (e.g., ethylene vinyl acetate (Elvax™ grades from Dupont));
- a strength enhancing agent provided by a chemically modified polyethylene (e.g., Fusabond™ from Dupont); and/or,
- a surfactant provided by a wax and a fluoroploymer (e.g., ethylene-bis-stearamide (Acrawax™ C grade from Lonza), and polyvinylidene fluoride (Kynar™ 2850 grade from Atofina)).

EXAMPLE 1

Tungsten-Stainless Steel-Polymer (1)

Figure 8:
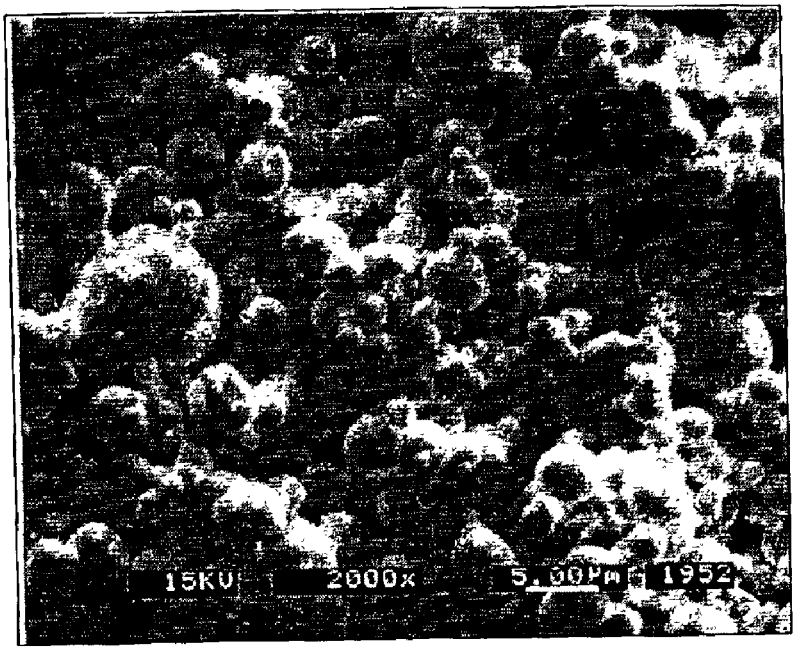
FIG. 8 is an electron micrograph of 17-4 PH stainless steel powder.
Figure 9:
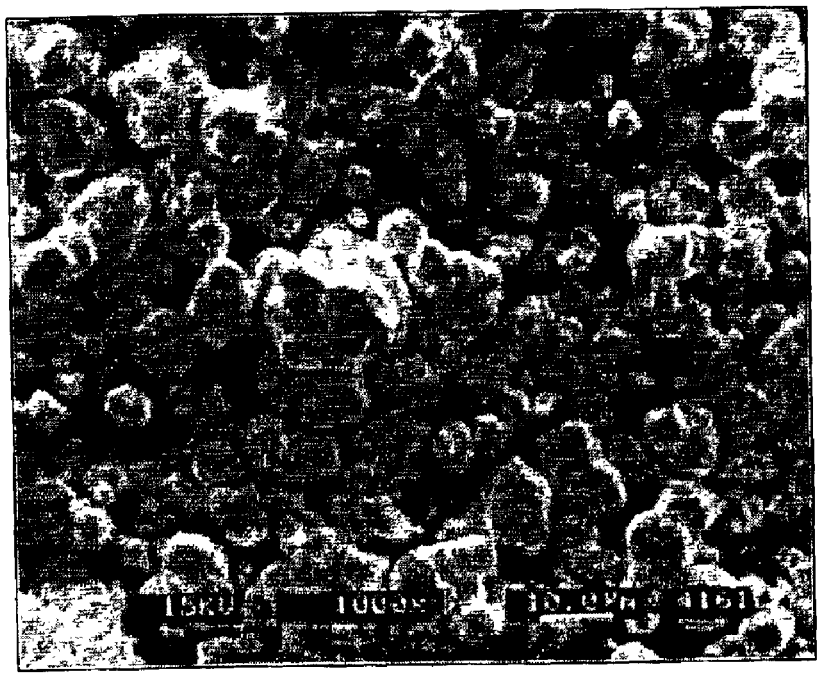
FIG. 9 is an electron micrograph of milled tungsten powder.
Figure 10:
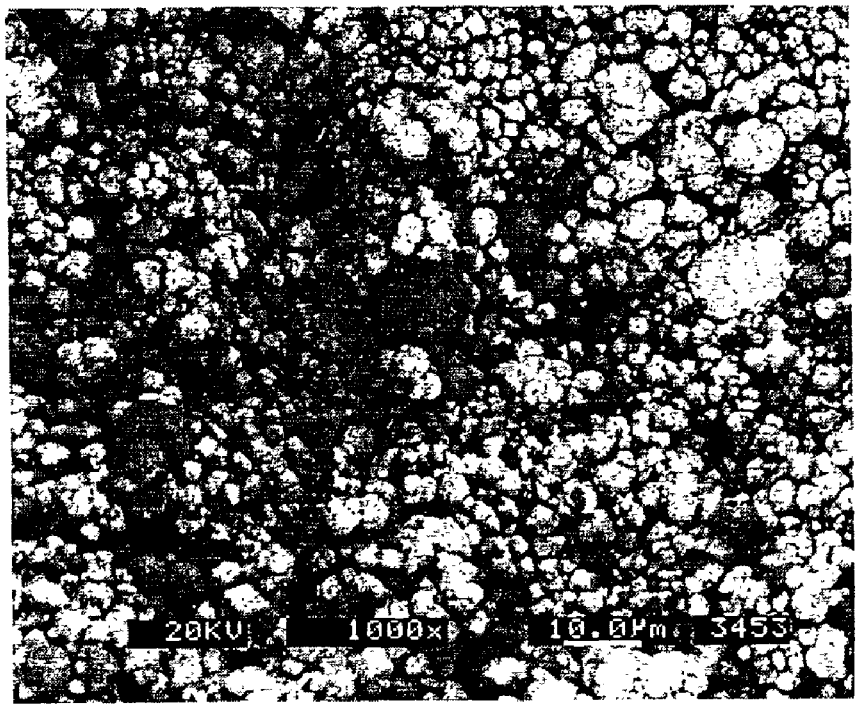
FIG. 10 is an electron micrograph of the fracture surface of a composite of the present invention.

A mixture of 17-4 PH stainless steel powder and milled tungsten powder was formulated with organic binders as shown in Table 1. The formulation was achieved by mixing the ingredients in a Sigma™ blade mixer at 220° C. and extruding the mixture out of a cylindrical die. The density of the mixture was 11.03 g/cc. An electron micrograph of the fracture surface of the resulting composite is shown in FIG. 10. FIG. 8 is an electron micrograph of 17-4PH stainless steel having the following particle size distribution: $D_{10}$=3.2 $\mu$m; $D_{50}$=6.9 $\mu$m; and $D_{90}$=11.8 $\mu$m. FIG. 9 is an electron micrograph of milled tungsten powder. The milled tungsten powder of FIG. 9 has an apparent density of 7.8 g/cc, a Tap density of 10.0 g/cc, a density determined by pycnometer of 19.173 g/cc and the following particle size distribution: $D_{10}$=5.65 $\mu$m; $D_{50}$=10.961 $\mu$m; and $D_{90}$=18.5 $\mu$m. Composition of the stainless steel powder (17-4 PH), from Osprey Metals Ltd, is shown in Table 1B.

TABLE 1A

| Metal Powders | Fractional wt. of metal powder | Amount in composite (% by wt.) | Density (g/cc) | Mass (g) |
|---|---|---|---|---|
| 17-4 PH stainless steel | 0.1 | 9.67 | 7.621 | 16.0 |
| tungsten | 0.9 | 87.06 | 19.2 | 144.01 |
| **Binder** | **Fractional wt. of binder** | **Amount in composite (% by wt.)** | **Density (g/cc)** | **Mass (g)** |
| Polypropylene (proFlow ™) | 0.45 | 1.47 | 1 | 2.43 |
| Ethylene vinyl acetate | 0.45 | 1.47 | 1 | 2.43 |
| Ethylene-bis-stearamide | 0.1 | 0.33 | 1 | 0.54 |

TABLE 1B

| Composition of 17-4 PH Stainless Steel | | | | | | | | | | | | |
|---|---|---|---|---|---|---|---|---|---|---|---|---|
| Cr | Cu | Ni | Mn | Si | Nb | N | Mo | O | C | P | S | Fe |
| 16.4 | 4.6 | 4.3 | 0.57 | 0.33 | 0.28 | 0.091 | 0.090 | 0.054 | 0.037 | 0.018 | 0.003 | Bal |

EXAMPLE 2

Tungsten-Stainless Steel-Polymer (2)

A mixture of 17-4 PH stainless steel powder, (FIG. 8), and milled tungsten powder (FIG. 9) was formulated with organic binder in proportions as in Table 2. Composition of the stainless steel powder (17-4PH), from Osprey Metals Ltd, is shown in Table 1B above. Formulation was achieved by initially mixing the ingredients in a Readco™ continuous compounder between 40–70° C. and injection moulding the compounded material at 230° C. with a mould temperature of 100° C. The injection speed was 200 ccm/s. The solids loading was 59 vol % and the density of the formulation was 11.34 g/cc.

TABLE 2

| Metal Powders | Fractional wt. of powder | Amount in composite (% by wt.) | Density (g/cc) | Mass (g) |
|---|---|---|---|---|
| 17-4 PH stainless steel | 0.025 | 2.41 | 7.75 | 819.34 |
| tungsten | 0.975 | 93.90 | 19.2 | 31954.16 |

| Binder | Fractional wt. of binder | Amount in composite (% by wt.) | Density (g/cc) | Mass (g) |
|---|---|---|---|---|
| Elvax ™ 450 | 0.05 | 0.18 | 0.95 | 62.74 |
| Pebax ™ 7233 | 0.88 | 3.25 | 1.02 | 1104.28 |
| Acrawax ™ C | 0.01 | 0.04 | 1.1 | 12.55 |
| Kynar ™ 2850 | 0.01 | 0.04 | 1.75 | 12.55 |
| Fusabond ™ MB 226D | 0.05 | 0.18 | 1.0 | 62.74 |

EXAMPLE 3

Tungsten-Stainless Steel-Polymer (3)

Figure 11:
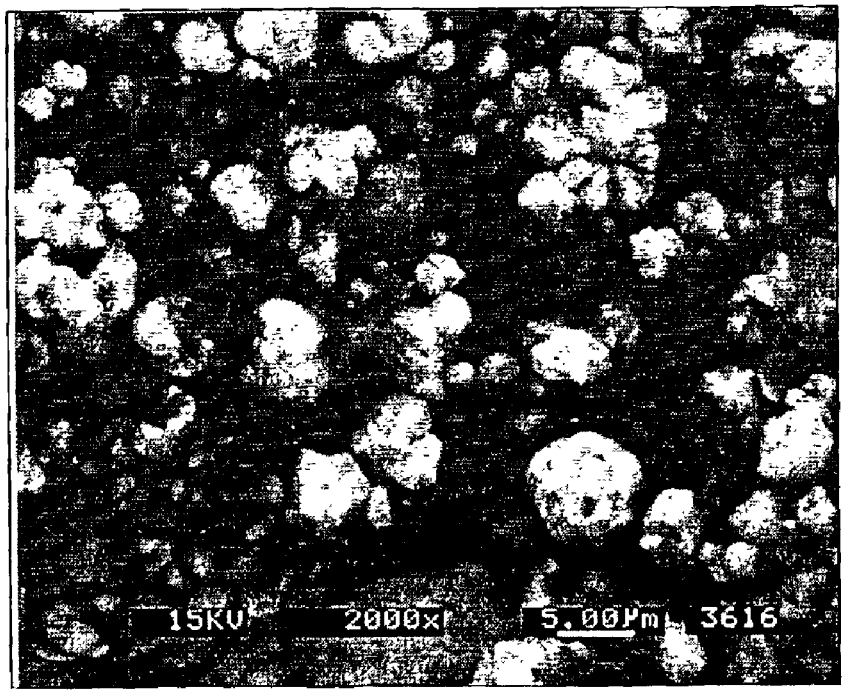
FIG. 11 is an electron micrograph of an extrudate produced in accordance with the present invention.

A mixture of 17-4 PH stainless steel powder, (FIG. 8), and milled tungsten powder (FIG. 9) was formulated with organic binder in proportions as shown in Table 3. Composition of the stainless steel powder (17-4PH), from Osprey Metals Ltd, is shown in Table 1B. Formulation was achieved by initially mixing the ingredients in a Readco™ continuous compounder between 40–70° C. and injection moulding the compounded material at 230° C. with a mould temperature of 100° C. The injection speed was 200 ccm/s. The solids loading was 59 vol % and the density of the formulation was 11.35 g/cc. The hardness (Hv) was found to be 23.1±1.5. Deformation characteristics (relative malleability) of this product were analysed by a fully calibrated falling weight test. (The falling weight test involved dropping a 847 gram weight from a height of 33 mm above the upper surface of a substantially spherical sample (3.5 mm nominal diameter) and measuring a change in thickness of the sample. The test can be viewed as a relative impact deformation measurement. A sample of a sphere made of the composite of the present invention was about 73% as thick after the test as before. In comparison, commercial lead shot was about 45% as thick and Tungsten Matrix™ shot (a tungsten/polymer shot from Kent Cartridge) was about 76% as thick. Thickness after impact was measured between the flat surfaces created by the impact. No fragmentation was observed in any of the materials, indicating malleability in all cases. The sample of the present invention has a malleability comparable to prior art tungsten/polymer composites while having a superior density. Particularly noteworthy is the capacity to load tungsten in the composite of the present invention to higher than the 56 vol %. An SEM image of the microstructure of the extrudate produced from the formulation in Example 3 is shown in FIG. 11.

TABLE 3

| Metal Powders | Fractional wt. of powder | Amount in composite (% by wt.) | Density (g/cc) | Mass (g) |
|---|---|---|---|---|
| 17-4 PH stainless steel | 0.025 | 2.41 | 7.75 | 136.56 |
| tungsten | 0.975 | 93.90 | 19.2 | 5325.69 |

| Binder | Fractional wt. of binder | Amount in composite (% by wt.) | Density (g/cc) | Mass (g) |
|---|---|---|---|---|
| Elvax ™ 450 | 0.45 | 1.7 | 0.95 | 96.58 |
| Hytrel ™ 5526 | 0.38 | 1.44 | 1.2 | 81.56 |

TABLE 3-continued

| | | | | |
|---|---|---|---|---|
| Acrawax ™ C | 0.01 | 0.04 | 1.1 | 2.15 |
| Kynar ™ 8250 | 0.01 | 0.04 | 1.75 | 2.15 |
| Fusabond ™ MB 226D | 0.15 | 0.57 | 1.0 | 32.19 |

EXAMPLE 4

Tungsten-Iron-Polymer (4)

Figure 12:
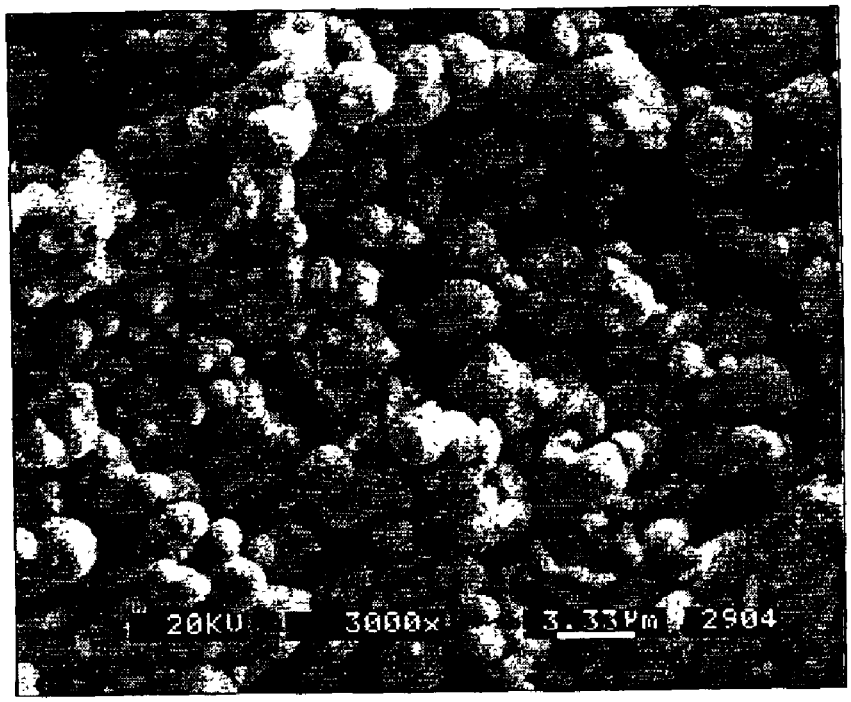
FIG. 12 is an electron micrograph of milled carbonyl iron powder.

A mixture of carbonyl iron powder, and milled tungsten powder (FIG. 9) was formulated with an organic binder in proportions as shown in Table 4. FIG. 12 is an electron micrograph of milled carbonyl iron powder having an apparent density of 2.76 g/cc; a Tap density of 3.82 g/cc; a density determined by pycnometer of 7.85 g/cc; and the following particle size distribution: $D_{10}$=1.98 μm; $D_{50}$=4.541 μm; and $D_{90}$=13.41 μm. Carbonyl iron powder, from Reade Advanced Materials, is essentially pure iron with traces of oxygen and carbon. Formulation was achieved by initially mixing the ingredients in a Readco™ continuous compounder between 40–70° C. and injection moulding the compounded material at 230° C. with a mould temperature of 100° C. The injection speed was 200 ccm/s. The solids loading was 59 vol % and the density of the formulation was 11.35 g/cc. The formulation was found to have Theological characteristics that confirmed that it was melt processible. The composite formed is strong and ductile and is softer on the surface than iron alone.

TABLE 4

| Metal Powders | Fractional wt. of powder | Amount in composite (% by wt.) | Density (g/cc) | Mass (g) |
|---|---|---|---|---|
| Carbonyl Iron | 0.025 | 2.41 | 7.8 | 819.65 |
| Tungsten | 0.975 | 93.91 | 19.2 | 31966.4 |

| Binder | Fractional wt. of binder | Amount in composite (% by wt.) | Density (g/cc) | Mass (g) |
|---|---|---|---|---|
| Elvax ™ 450 | 0.05 | 0.18 | 0.95 | 62.74 |
| Pebax ™ 7233 | 0.88 | 3.24 | 1.02 | 1104.28 |
| Acrawax ™ C | 0.01 | 0.04 | 1.1 | 12.55 |
| Kynar ™ 2850 | 0.01 | 0.04 | 1.75 | 12.55 |
| Fusabond ™ MB 226D | 0.05 | 0.18 | 1.0 | 62.74 |

EXAMPLE 5

Bronze-Tungsten-Polymer (5)

Figure 15:
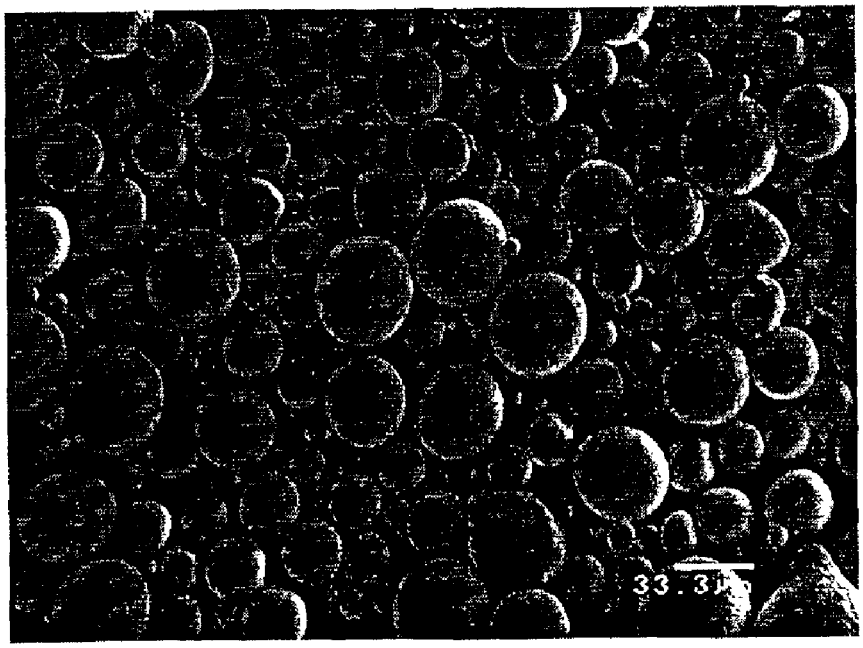
FIG. 15 is an electron micrograph of bronze powder.
Figure 16:
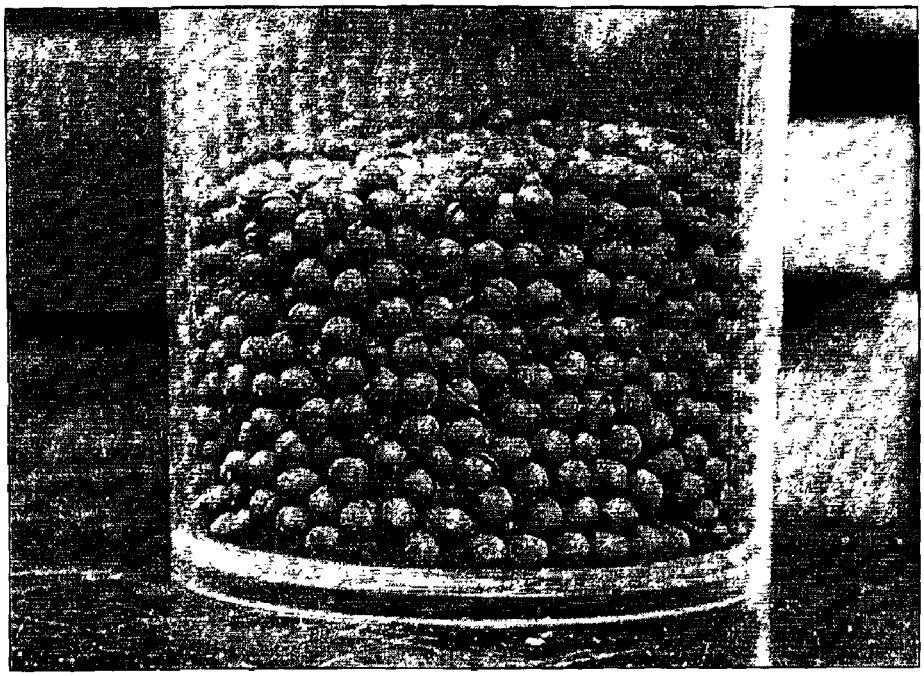
FIG. 16 is a picture of shot produced in accordance with the present invention.

A mixture of bronze powder, and milled tungsten powder (FIG. 9) was formulated with an organic binder in proportions as shown in Table 5. FIG. 15 is an electron micrograph of bronze powder 300× magnification. Formulation was achieved by initially mixing the ingredients in a Readco™ continuous compounder between 40–70° C. and injection moulding the compounded material at 230° C. with a mould temperature of 100° C. The injection speed was 200 ccm/s. The solids loading was 59 vol % and the density of the formulation was 11.43 g/cc. The formulation was found to have rheological characteristics that confirmed that it was melt processible. The composite formed is strong and ductile and is softer on the surface than bronze alone. Examples of shot that have been produced using the formulation in Example 5 and using a compounding, extrusion and roll-heading operation are shown in FIG. 16.

TABLE 5

| Metal Powders | Fractional wt. of powder | Amount in composite (% by wt.) | Density (g/cc) | Mass (g) |
|---|---|---|---|---|
| Bronze | 0.025 | 2.41 | 7.8 | 275.24 |
| Tungsten | 0.975 | 93.93 | 19.2 | 10734.23 |
| **Binder** | **Fractional wt. of binder** | **Amount in composite (% by wt.)** | **Density (g/cc)** | **Mass (g)** |
| Elvax ™ 450 | 0.05 | 0.18 | 0.95 | 20.91 |
| Pebax ™ 7233 | 0.88 | 3.22 | 1.02 | 368.09 |
| Acrawax ™ C | 0.01 | 0.04 | 1.1 | 4.18 |
| Kynar ™ 2850 | 0.01 | 0.04 | 1.75 | 4.18 |
| Fusabond ™ MB 226D | 0.05 | 0.18 | 1.0 | 20.91 |

EXAMPLE 6

Tungsten-Stainless Steel-Polymer (6)

A mixture of 17-4 PH stainless steel powder, (FIG. 8), and milled tungsten powder (FIG. 9) was formulated with organic binder in proportions as in Table 6. Composition of the stainless steel powder (17-4PH), from Osprey Metals Ltd, is shown in Table 1B above. Formulation was achieved by pre-blending the ingredients in a particulate form in a Readco™ twin-screw compounder. The temperature settings were 190° C., 200° C. and 210° C. in three zones between the feeder and the die plate. The die plate was air cooled and maintained at 150° C. The motor was running at 105 rpm and was drawing 3.5–3.7 horsepower. The composite was granulated while exiting from the compounder. The composite was passed through the compounder three times before feeding into a Haake twin-screw extruder that had temperature settings of 60° C. at the feedstock inlet, 120° C. at the barrel, and 100° C. at the die. The composite was fed through the extruder at 210 cc/minute and the screw speed was 170 rpm. Cylindrical wires were extruded in this manner through a 3 mm die for shot formation at a 4" drop to the rolls. The solids loading was 58 vol % and the density of the formulation was 11.12 g/cc.

TABLE 6

| Metal Powders | Fractional wt. of powder | Amount in composite (% by wt.) | Density (g/cc) | Mass (g) |
|---|---|---|---|---|
| 17-4 PH stainless steel | 0.025 | 2.41 | 7.75 | 134.24 |
| tungsten | 0.975 | 94.13 | 19.2 | 5235.43 |
| **Binder** | **Fractional wt. of binder** | **Amount in composite (% by wt.)** | **Density (g/cc)** | **Mass (g)** |
| Elvax ™ 450 | 0.6 | 2.08 | 0.95 | 115.42 |
| Nordel ™ IP 4570 | 0.38 | 1.31 | 0.86 | 73.10 |
| Acrawax ™ C | 0.02 | 0.07 | 1.1 | 3.85 |

Figure 13:
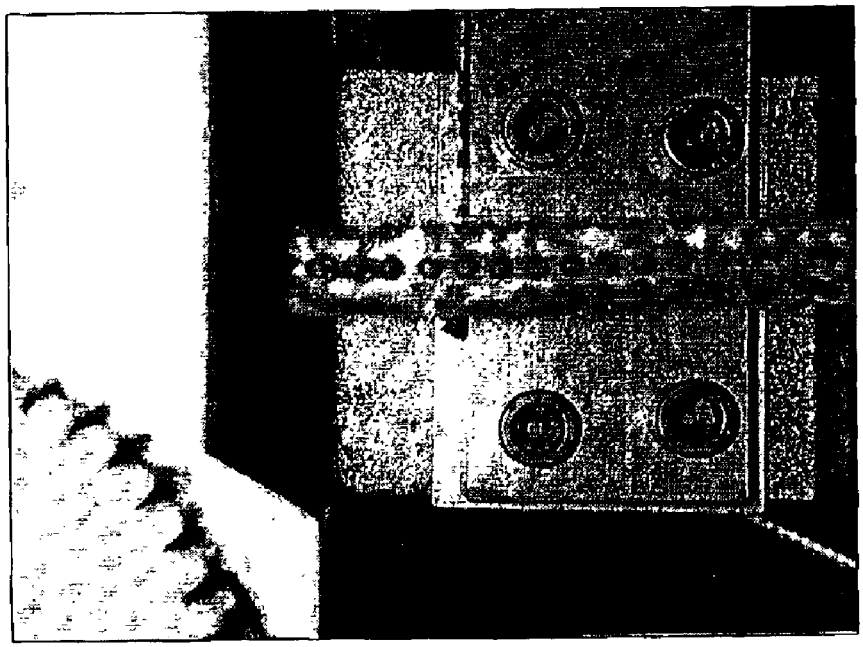
FIG. 13 is a photograph of shot being produced by heading or roll-forming technique.
Figure 14:
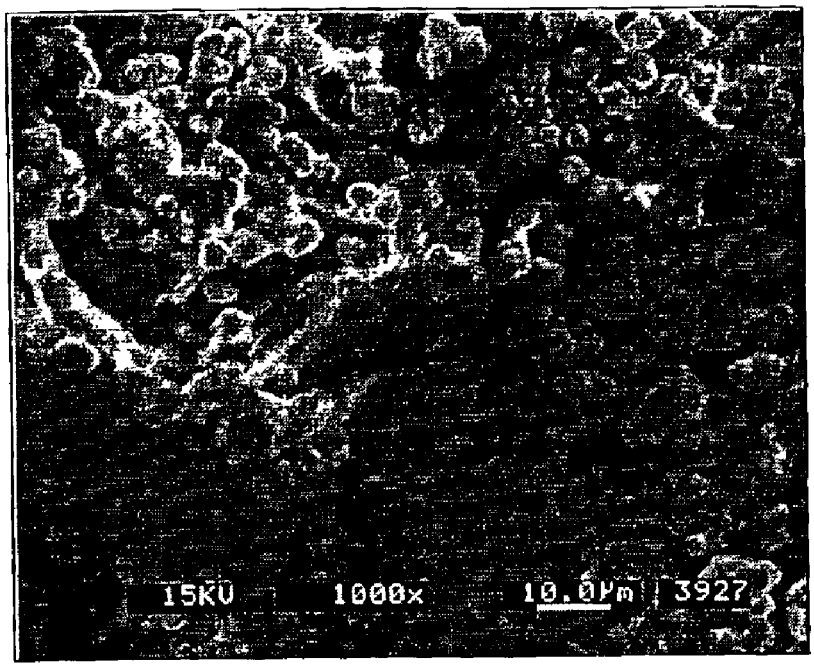
FIG. 14 is an electron micrograph of the microstructure of shot formed according to the present invention.

Examples of shot that have been produced using the formulations in Examples 1–4 and using a compounding, extrusion and roll-heading operation are shown in FIG. 13 with SEM image of the shot material shown in FIG. 14. Shot produced using a composite of Examples 1–4 exhibit superior ballistics properties. Shotgun patterns from a 12-gauge shotgun show high pattern density and even spread with a growing pattern. The shot is particularly useful for shooting bird game, such as pheasants and partridge, at short range.

Other advantages which are inherent to the structure are obvious to one skilled in the art. It is apparent to one skilled in the art that many variations on the present invention can be made without departing from the scope or spirit of the invention claimed herein.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying figures is to be interpreted as illustrative and not in a limiting sense.

Having described the invention, what is claimed is:

1. A composite comprising: tungsten powder having a mean particle size of 0.5–50 μm; another metal powder having a mean particle size of 1–50 μm and having a packing density of 62 vol % or greater, and, a thermoplastic elastomer selected from the group consisting of polyether block amides, polyester elastomers, melt processible rubber, chlorinated polyethylene, ethylene propylene diene monomer rubber, polyamide elastomers, polyolefin elastomers, thermoplastic polyurethanes and blends thereof.

2. The composite of claim 1, wherein the composite consists essentially of milled tungsten powder, stainless steel powder, a polyester elastomer, ethylene vinyl acetate, a chemically modified polyethylene, ethylene-bis-stearamide and polyvinylidene fluoride.

3. The composite of claim 2, wherein the tungsten is present in an amount of 93.90 wt %, the stainless steel is present in an amount of 2.41 wt %, the polyester elastomer is present in an amount of 1.44 wt %, the ethylene vinyl acetate is present in an amount of 1.7 wt %, the chemically modified polyethylene is present in an amount of 0.57 wt %, the ethylene-bis-stearamide is present in an amount of 0.04 wt %, and the polyvinylidene fluoride is present in an amount of 0.04 wt %, all weights based on weight of the composite.

4. The composite of claim 1, wherein the composite consists essentially of milled tungsten powder, bronze powder having a 90:10 ratio of Cu:Sn, a polyester elastomer, ethylene vinyl acetate, a chemically modified polyethylene, ethylene-bis-stearamide and polyvinylidene fluoride.

5. The composite of claim 4, wherein the tungsten is present in an amount of 93.93 wt %, the bronze is sent in an amount of 2.41 wt %, the polyester elastomer is present in an amount of 3.22 wt %, the ethylene vinyl acetate is present in an amount of 0.18 wt %, the chemically modified polyethylene is present in an amount of 0.18 wt %, the ethylene-bis-stearamide is present in an amount of 0.04 wt %, and the polyvinylidene fluoride is present in an amount of 0.04 wt %, all weights based on weight of the composite.

6. The composite of claim 1, further comprising a rheology modifier, a strength enhancing agent and surfactant.

7. The composite of claim 6, wherein the tungsten powder has a mean particle size of 0.5–50 μm and is present in an amount of 80–97% by weight of the composite, the other metal powder has a mean particle size of 1–50 μm and is present in an amount of from 2–15% by weight of the composite, and the thermoplastic elastomer, the rheology modifier, the strength enhancing agent and the surfactant are collectively present in an amount of 1–10% by weight of the composite.

8. The composite of claim 7, wherein the other metal powder is bronze having a 90:10 ratio of Cu:Sn or stainless steel, and wherein the thermoplastic elastomer comprises a polyester elastomer or a polyether block amide.

9. A finished article of manufacture comprising an unsintered composite comprising: tungsten powder having a mean particle size of 0.5–50 μm; another metal powder having a mean particle size of 1–50 μm and having a packing density of 62 vol % or greater; and, a thermoplastic elastomer selected from the group consisting of polyether block amides, polyester elastomers, melt processible rubber, chlorinated polyethylene, ethylene propylene diene monomer rubber, polyamide elastomers, polyolefin elastomers, thermoplastic polyurethanes and blends thereof.

10. The article of claim 9, wherein the composite further comprises a rheology modifier a strength enhancing agent and a surfactant.

11. The article of claim 9, wherein the tungsten powder has is present in an amount of 80–97 wt % and the other metal powder is present in an amount of 2–15 wt %, all weights based on the weight of the composite.

12. The article of claim 9, wherein the tungsten powder has a mean particle size of 2–20 μm and is present in an amount of 80–96 wt % and the other metal powder has a mean particle size of 5–25 μm and is present in an amount of 2–15 wt %, all weights based on the weight of the composite.

13. The article of claim 10, wherein the tungsten powder is present in an amount of 80–97 wt %, the other metal powder is present in an amount of 2–15 wt %, and the thermoplastic elastomer, rheology modifier, strength enhancing agent and surfactant collectively are present in an amount of 1–10 wt %, all weights based an the weight of the composite.

14. The article of claim 10, wherein the tungsten powder has a mean particle size of 2–20 μm and is present in an amount of 80–96 wt %, the other metal powder has a mean particle size of 5–25 μm and is present in an amount of 2–15 wt %, and the thermoplastic elastomer, rheology modifier, strength enhancing agent and surfactant collectively are present in an amount of 2–6 wt %, all weights based on the weight of the composite.

15. The article of claim 14, wherein the other metal powder is bronze having a 90:10 ratio of Cu:Sn or stainless steel, and the thermoplastic elastomer comprises a polyester elastomer or a polyether block amide.

16. The article of claim 15, wherein the rheology modifier comprises ethylene vinyl acetate, the strength enhancing agent comprises a chemically modified polyethylene, and the surfactant comprises a wax, fluoropolymer or blend thereof.

17. The article of claim 16, wherein the wax comprises ethylene-bis-stearamide and the fluoropolymer comprises polyvinylidene fluoride.

18. The article of claim 17, wherein the tungsten powder has been milled to deagglomerate fine particle clusters.

19. The article of claim 9, wherein the composite consists essentially of milled tungsten powder, stainless steel powder, a polyester elastomer, ethylene vinyl acetate, a chemically modified polyethylene, ethylene-bis-stearamide and polyvinylidene fluoride.

20. The article of claim 19, wherein the tungsten is present in an amount of 93.90 wt %, the stainless steel is present in an amount of 2.41 wt %, the polyester elastomer is present in an amount of 1.44 wt %, the ethylene vinyl acetate is present in an amount of 1.7 wt %, the chemically modified polyethylene is present in an amount of 0.57 wt %, the ethylene-bis-stearamide is present in an amount of 0.04 wt %, and the polyvinylidene fluoride is present in an amount of 0.04 wt %, all weights based on weight of the composite.

21. The article of claim 9, wherein the composite consists essentially of milled tungsten powder, bronze powder having a 90:10 ratio of Cu:Sn, a polyester elastomer, ethylene vinyl acetate, a chemically modified polyethylene, ethylene-bis-stearamide and polyvinylidene fluoride.

22. The article of claim 21, wherein the tungsten is present in an amount of 93.93 wt %, the bronze is present in an amount of 2.41 wt %, the polyester elastomer is present in an amount of 3.22 wt %, the ethylene vinyl acetate is present in an amount of 0.18 wt %, the chemically modified polyethylene is present in an amount of 0.18 wt %, the ethylene-bis-stearamide is present in an amount of 0.04 wt %, and the polyvinylidene fluoride is present in an amount of 0.04 wt %, all weights based on weight of the composite.

23. The article of claim 9 which is ammunition a weight, radiation shielding or a high density gyroscopic ballast.

24. The article of claim 9 which is shot or a bullet core.

25. The article of claim 19 which is shot or a bullet core.

26. The article of claim 20 which is shot or a bullet core.

27. The article of claim 21 which is shot or a bullet core.

28. The article of claim 22 which is shot or a bullet core.

29. A finished article of manufacture composing an unsintered composite consisting essentially of:

80–96 wt % milled tungsten powder having a mean particle size of 2–20 μm;

2–15 wt % bronze powder or stainless steel powder having a mean particle size of 1–40 μm and a packing density of 62 vol % or greater, the bronze having a 90:10 ratio of Cu:Sn; and, 2–6 wt % organic binder consisting essentially of a thermoplastic elastomer selected from the group consisting of polyether block amides, polyester elastomers, melt processible rubber, chlorinated polyethylene, ethylene propylene diene monomer rubber, polyamide elastomers, polyolefin elastomers, thermoplastic polyurethanes and blends thereof, a rheology modifier, a strength enhancing agent, and a surfactant.

30. The article of claim 29, wherein the thermoplastic elastomer comprises a polyester elastomer or a polyether block amide.

31. The article of claim 30, wherein the rheology modifier comprises ethylene vinyl acetate, the strength enhancing agent comprises a chemically modified polyethylene, and the surfactant comprises ethylene-bis-stearamide and polyvinylidene fluoride.

32. The article of claim 29 which is shot or a bullet core.

33. The article of claim 31 which is shot or a bullet core.

* * * * *